US010252889B2

(12) United States Patent
Bruno et al.

(10) Patent No.: US 10,252,889 B2
(45) Date of Patent: Apr. 9, 2019

(54) METHOD OF INSTALLING A MACHINE IN AN ELEVATOR SYSTEM

(75) Inventors: Gilles Bruno, Chateauneuf sur Loire (FR); Jacques Greuin, Arrabloy (FR); Fabrice Hamon, Les Choux (FR); Michael John Barton, Bolton Lancashire (GB); Jean-Louis Goussot, Puteaux (FR); Uwe Lassen, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 497 days.

(21) Appl. No.: 14/398,162

(22) PCT Filed: May 2, 2012

(86) PCT No.: PCT/US2012/036113

§ 371 (c)(1),
(2), (4) Date: Oct. 31, 2014

(87) PCT Pub. No.: WO2013/165411

PCT Pub. Date: Nov. 7, 2013

(65) Prior Publication Data

US 2015/0083525 A1 Mar. 26, 2015

(51) Int. Cl.
*B66B 11/04* (2006.01)
*B66B 19/00* (2006.01)

(52) U.S. Cl.
CPC ..... *B66B 19/00* (2013.01); *B66B 11/04* (2013.01); *B66B 19/005* (2013.01); *Y10T 29/49826* (2015.01)

(58) Field of Classification Search
CPC ..... B66B 11/04; B66B 19/005
See application file for complete search history.

(56) References Cited

U.S. PATENT DOCUMENTS 4,664,230 A * 5/1987 Olsen ..... B66B 11/0469 187/255
5,788,018 A 8/1998 Mendelsohn et al.
6,230,844 B1 * 5/2001 Latorre ..... B66B 11/0045 187/254
6,446,762 B1 * 9/2002 St. Pierre ..... B66B 7/02 187/406

(Continued)

FOREIGN PATENT DOCUMENTS

CN 1839089 A 9/2006
CN 200995925 Y 12/2007

(Continued)

OTHER PUBLICATIONS

English Machine Translation of JP 2000-034072.*

(Continued)

*Primary Examiner* — Diem M Tran
(74) *Attorney, Agent, or Firm* — Cantor Colburn LLP

(57) ABSTRACT

A method for installing an elevator drive machine in a machine room-less elevator system is provided. A drive machine assembly is fastened to a counterweight. The counterweight is then lifted vertically along a set of counterweight guide rails to the top of the hoistway. There, the drive machine assembly is mounted to the ends of the counterweight guide rails. Once in place, the drive machine assembly is then disconnected from the counterweight.

18 Claims, 6 Drawing Sheets

(56) References Cited

U.S. PATENT DOCUMENTS

| | | | | |
|---|---|---|---|---|
| 6,446,763 | B1 * | 9/2002 | Glassey | B66B 19/007 187/414 |
| 6,488,124 | B1 | 12/2002 | Yasuda et al. | |
| 6,672,013 | B1 * | 1/2004 | Glassey | B66B 19/002 187/406 |
| 6,857,508 | B2 * | 2/2005 | Miller | B66B 19/005 187/401 |
| 7,264,087 | B2 | 9/2007 | Hawkins | |
| 7,635,049 | B2 * | 12/2009 | Van Der Meijden | B66B 19/002 187/401 |
| 8,118,138 | B2 | 2/2012 | Aulanko et al. | |
| 8,485,319 | B2 * | 7/2013 | Peacock | B66B 7/027 187/414 |
| 2006/0266592 | A1 * | 11/2006 | Monzon | B66B 7/062 187/412 |
| 2007/0181381 | A1 * | 8/2007 | Jungbauer | B66B 9/187 187/401 |
| 2007/0256899 | A1 | 11/2007 | Fanielle et al. | |
| 2009/0097952 | A1 * | 4/2009 | Swaybill | B66B 19/005 414/589 |
| 2010/0084224 | A1 * | 4/2010 | Hao | B66B 11/0045 187/254 |
| 2012/0145489 | A1 * | 6/2012 | Tian | B66B 19/005 187/406 |

FOREIGN PATENT DOCUMENTS

| | | | |
|---|---|---|---|
| CN | 100564225 | C | 12/2009 |
| JP | 2000034072 | A | 2/2000 |
| JP | 2011132012 | A | 7/2011 |
| KR | 20090038456 | A | 4/2009 |
| WO | 2005030631 | A1 | 4/2005 |

OTHER PUBLICATIONS

Chinese Office Action for Application No. 201280072926.0 dated Aug. 4, 2016; 3 pgs.

International Search Report dated Nov. 23, 2013 for PCT/US2012/036113 filing date May 2, 2012, 5 pages.

Written Opinion of International Search Report dated Nov. 23, 2012, for PCT/2012/036113 filing date May 2, 2012, 3 pages.

Extended European Search Report for Application No. 12875889.3 dated Jul. 20, 2015; 11 pages.

Chinese Office Action for Appln. No. 201280072926.0; dated Feb. 16, 2017; Due Date: May 3, 2017; 8 pages.

CN Decision of Rejection with Translation; CN Application No. 201280072926.0; dated Aug. 23, 2017, pp. 1-19.

CN Office Action with translation; Application No. 201280072926.0; dated Nov. 17, 2015, pp. 1-5.

CN Second Office Action with translation; Application No. 201280072926.0; dated Aug. 4, 2016, pp. 1-18.

EP Communication Pursuant to Rule 164(1) EPC; Application No. 12875889.36/1705 / 2844600 PCT/US2012036113; dated Mar. 24, 2015, pp. 1-5.

PCT International Preliminary Report on Patentability IPRP; International Application No. PCT/US2012/036113; International Filing Date: May 2, 2012, dated Nov. 4, 2014, pp. 1-4

* cited by examiner

METHOD OF INSTALLING A MACHINE IN AN ELEVATOR SYSTEM

CROSS REFERENCE TO RELATED APPLICATIONS

This application claims the benefit of PCT International Application Serial No. PCT/US2012/36113 filed on May 2, 2012, the contents of which are incorporated herein by reference thereto.

BACKGROUND OF THE INVENTION

This invention generally relates to the field of elevator installation and maintenance, and more particularly to a method of installing an elevator machine within a hoistway.

A typical traction elevator system includes a car and a counterweight disposed within a hoistway, a plurality of tension ropes that interconnect the car and counterweight, and a drive machine having a drive sheave engaged with the tension ropes to drive the car and the counterweight. The ropes, and thereby the car and counterweight, are driven by rotating the drive sheave. Traditionally, the drive machine and its associated equipment were housed in a separate machine room.

Newer elevator systems have eliminated the need for a separate machine room by mounting the drive machine near the ceiling of the hoistway. These elevator systems are referred to as machine room-less systems. Installing a drive machine in a hoistway of a machine room-less elevator system typically entails lifting the drive machine into position from either a floor of the building or an elevator car. This typically requires sufficient overhead space in the hoistway to allow for transport and repositioning of the drive machine to the mounting location. After mounting the drive machine, this overhead space is not necessary for the operation of the elevator system, and is therefore wasted space that adds to the overall construction cost without providing a continuing benefit. Additionally, in some cases it is not feasible to have a hoistway with sufficient overhead space.

SUMMARY OF THE INVENTION

According to an exemplary embodiment of the invention, a method for installing an elevator drive machine in a machine room-less elevator system includes fastening a drive machine assembly to the counterweight. The counterweight and the attached drive machine assembly are then lifted vertically along a set of counterweight guide rails to the top of the hoistway. With the counterweight and the drive machine assembly at the top of the hoistway, the drive machine assembly, without being repositioned, is mounted to the ends of the counterweight guide rails. Once it is secured in place, the drive machine assembly is disconnected from the counterweight.

Alternatively, in this or other aspects of the invention, the drive machine assembly is vertically aligned with the counterweight.

Alternatively, in this or other aspects of the invention, the drive machine assembly includes both a drive machine and a bedplate.

Alternatively, in this or other aspects of the invention, the drive machine has a first foot and a second foot, and the bedplate includes a first arm and a second arm. The first foot of the drive machine is mounted to the first arm of the bedplate, and the second foot of the drive machine is mounted to the second arm of the bedplate.

Alternatively, in this or other aspects of the invention, the drive machine is mounted to the bedplate before the bedplate is mounted to the counterweight.

Alternatively, in this or other aspects of the invention, the bedplate is mounted to the counterweight before the drive machine is mounted to the bedplate.

Alternatively, in this or other aspects of the invention, a bedplate mounting bracket is connected to a surface of the bedplate. This bedplate mounting bracket is fastened to the crosshead of the counterweight.

Alternatively, in this or other aspects of the invention, the bedplate mounting bracket is fastened to an upper surface of the counterweight.

Alternatively, in this or other aspects of the invention, the drive machine assembly is disconnected from the counterweight by unfastening the bedplate mounting bracket from the crosshead.

Alternatively, in this or other aspects of the invention, the counterweight does not include filler weights.

Alternatively, in this or other aspects of the invention, the counterweight is moved vertically along the counterweight guide rails using a hoisting device.

Alternatively, in this or other aspects of the invention, the counterweight includes hoisting brackets for coupling the counterweight to the hoisting device.

Alternatively, in this or other aspects of the invention, a car rail bracket is mounted to a portion of the bedplate when the drive machine assembly is being mounted to the counterweight guide rails.

Alternatively, in this or other aspects of the invention, the bedplate includes a crossbeam. At least one support piece is mounted to each end of the cross beam before the drive machine assembly is mounted to the counterweight guide rails.

Alternatively, in this or other aspects of the invention, the support pieces connected to each end of the crossbeam mount through a spacer and to a counterweight guide rail bracket.

Alternatively, in this or other aspects of the invention, the support pieces fastened to each end of the crossbeam are variable. The support pieces can be used to adapt the drive machine assembly to multiple elevator system configurations.

Alternatively, in this or other aspects of the invention, after the drive machine assembly is mounted to the counterweight guide rails, a car guide rail is installed adjacent the counterweight.

Alternatively, in this or other aspects of the invention, an end of a car guide rail is fastened to the car guide rail bracket.

According to another embodiment of the invention, an elevator system is provided including a counterweight coupled to at least one counterweight guide rail for movement in a hoistway. The elevator system also includes a bedplate having a crossbeam and a plurality of mounting legs mounted to the crossbeam. A machine assembly is mounted at an end of the counterweight guide rails. When mounted, the machine assembly is vertically aligned with the counterweight. The machine assembly is mounted to the bedplate. A first support piece is mounted at a first end of the crossbeam and a second support piece is mounted to the second end of the crossbeam to extend the length of the crossbeam. At least one of the first support piece and the second support piece is mounted to the counterweight guide rail.

Alternatively, in this or other aspects of the invention, the bedplate includes a second crossbeam mounted between at least two of the plurality of mounting legs.

Alternatively, in this or other aspects of the invention, the at least one of the first support piece and the second support piece is mounted to the counterweight guide rail with a counterweight guide rail bracket.

Alternatively, in this or other aspects of the invention, a spacer is positioned between the at least one counterweight guide rail bracket and the at least one of the first support piece and the second support pieces.

Alternatively, in this or other aspects of the invention, a car guide rail bracket is mounted to the bedplate.

Alternatively, in this or other aspects of the invention, a car guide rail is mounted to the car guide rail bracket.

BRIEF DESCRIPTION OF THE DRAWINGS

The subject matter, which is regarded as the invention, is particularly pointed out and distinctly claimed in the claims at the conclusion of the specification. The features and advantages of the invention are apparent from the following detailed description taken in conjunction with the accompanying drawings, in which:

The detailed description of the invention describes exemplary embodiments of the invention, together with some of the advantages and features thereof, by way of example with reference to the drawings.

DETAILED DESCRIPTION OF THE INVENTION

Figure 1:
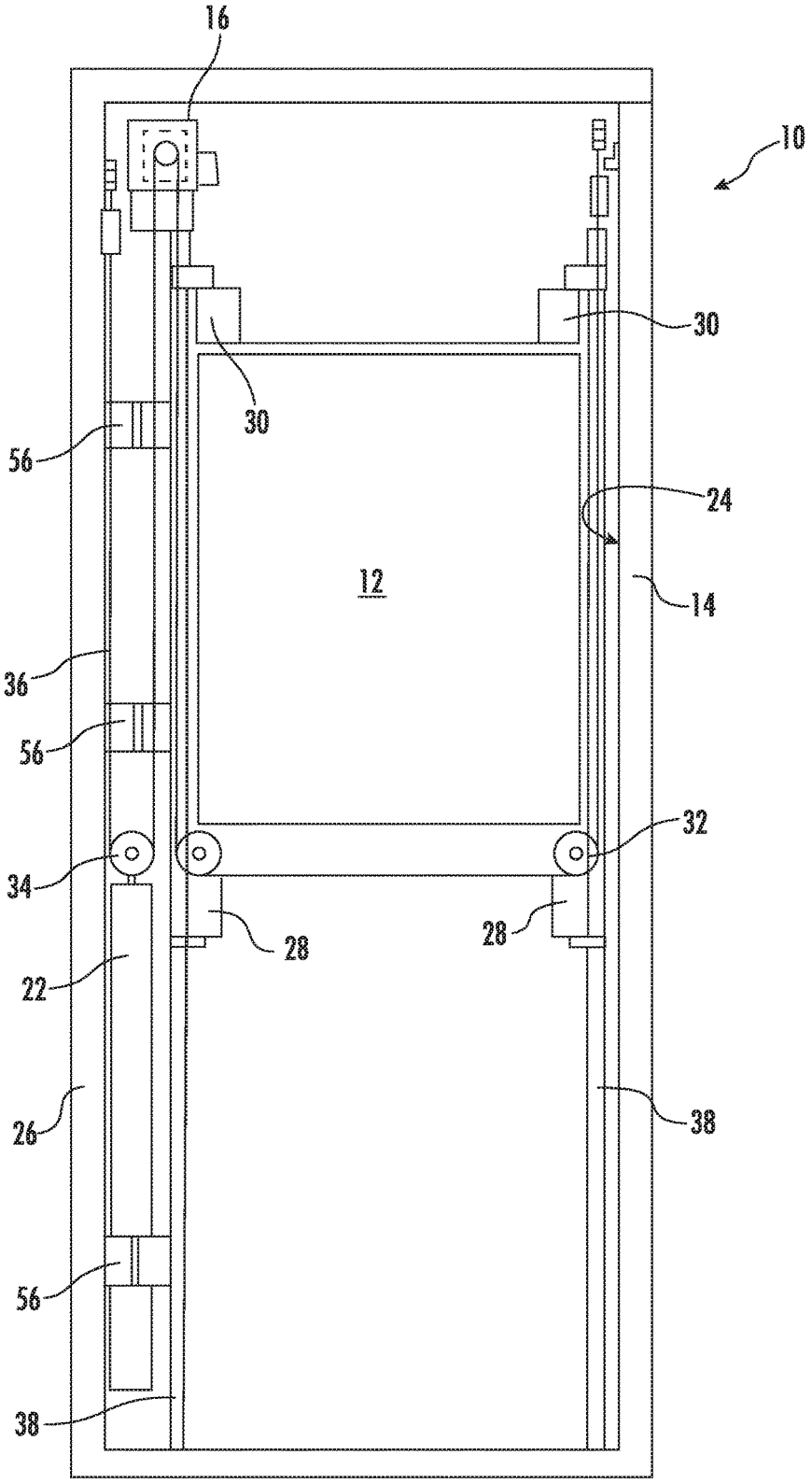
FIG. 1 is a cross-sectional view of a machine room-less elevator system in a hoistway.

Referring now to FIG. 1, an exemplary elevator system 10 is illustrated. A hoistway 14 includes a car guide rail 38 positioned on an interior wall 24 of the hoistway 14 and a car guide rail 38 mounted to counterweight brackets 56. The counterweight brackets 56 may be mounted to an opposite interior wall 26. Alternatively, the guide rail may be mounted directly to the opposite interior wall 26, or mounted to the opposite interior wall 26 using separate brackets. The car guide rails 38 guide vertical movement of an elevator car 12 within the hoistway 14. The elevator car 12 also includes guide assemblies 28, 30 disposed on the top and bottom of the elevator car 12 for maintaining proper alignment of the elevator car 12 as it moves along the car guide rails 38.

The counterweight brackets 56 effectively define a space extending the entire height of the hoistway 14 for movement of a counterweight 22. The term counterweight 22 as used herein includes a counterweight assembly that may itself include various components as would be understood by a person skilled in the art. The counterweight 22 moves opposite the elevator car 12 as is known in conventional elevator systems. The counterweight 22 is guided by counterweight guide rails 40 (see FIG. 2) mounted within the hoistway 14. The elevator car 12 and counterweight 22 include sheave assemblies 32, 34 that cooperate with traction belts 36 and drive machine 16 to raise and lower the elevator car 12. The drive machine 16 in this exemplary embodiment of the invention is suited and sized for use with flat traction belts 36. In the illustrated example, the sheave assemblies 32 are mounted to a base of the elevator car 12. However, the sheave assemblies 32 may be mounted at another location on the elevator car 12 or elsewhere in the system 10 as recognized by a person skilled in the art.

The drive machine 16 of the exemplary elevator system 10 is positioned and supported at a mounting location atop at least one of the counterweight guide rails 40. By supporting the machine 16 atop the counterweight guide rails 40 the need for a separate machine room, as required in conventional elevator systems, is eliminated. The machine room-less elevator system 10 according to the exemplary embodiment of the inventions requires much less overhead space in the hoistway 14 than conventionally installed systems, and eliminates the need for a separate machine room. The illustrated roping configuration and hoistway layout are only exemplary, and the teachings provided herein may be applied to other system configurations.

Figure 2:
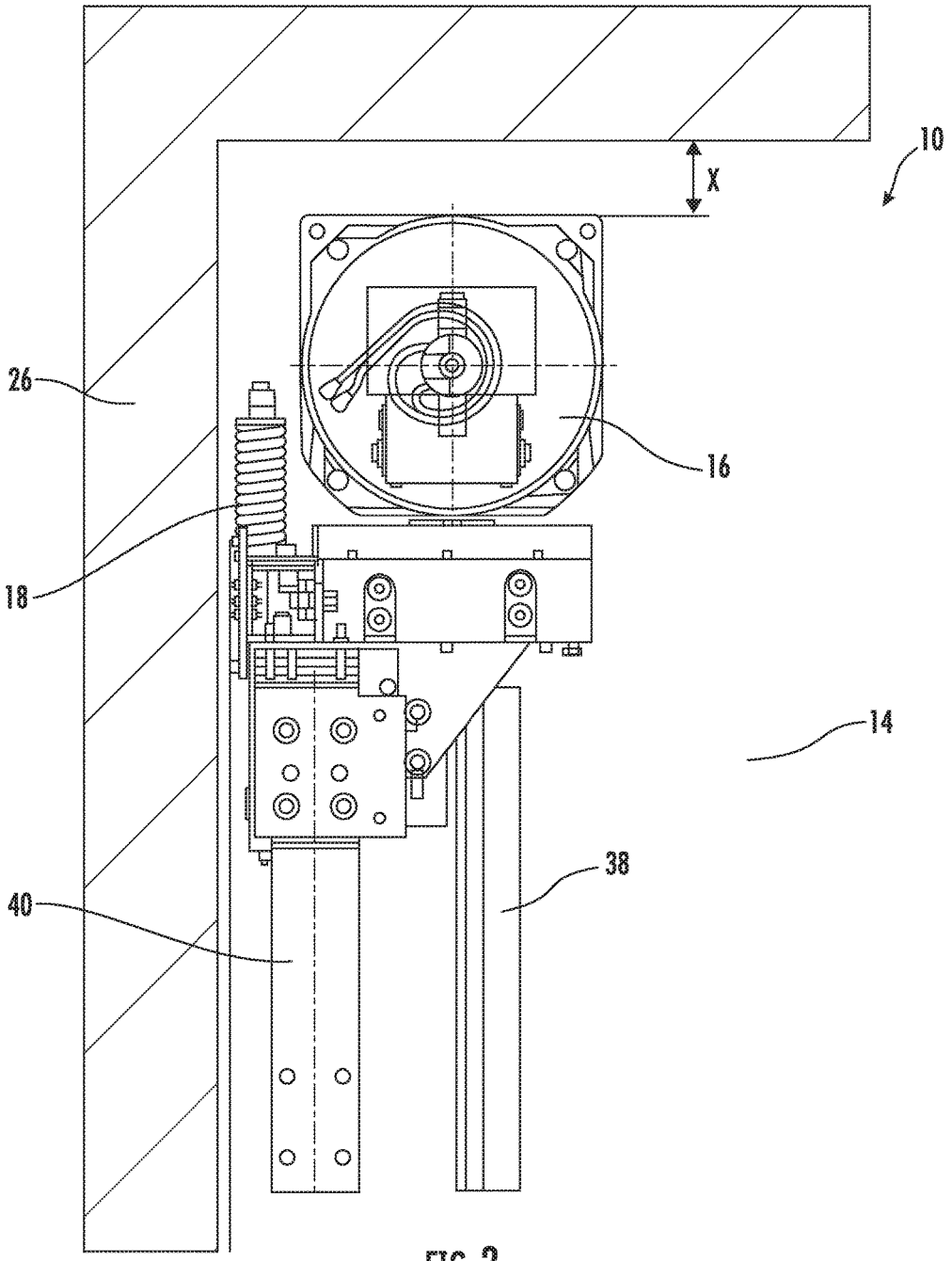
FIG. 2 is a side-view of a portion of a machine room-less elevator system according to an exemplary embodiment of the invention.

Referring now to FIG. 2, a portion of a machine room-less elevator system 10 according to an embodiment of the invention is illustrated. A termination assembly 18 supports the counterweight-side end of each the traction belts 36 in the elevator system 10. The counterweight side terminations 18 may be integrated with the bedplate for the drive machine 16. The drive machine 16 is supported by a counterweight guide rail 40 disposed on each side of the counterweight as well as a car guide rail 38, mounted in a direction perpendicular to each of the counterweight guide rails 40. As illustrated, the clearance X between the drive machine 16 and the top of the hoistway is very limited. In one embodiment, the clearance is less than about 5 millimeters, or 2 inches. The small clearance X between the top of the hoistway 14 and the drive machine 16 makes it difficult or impossible to install the drive machine 16 using previously known installation methods.

Figure 3:
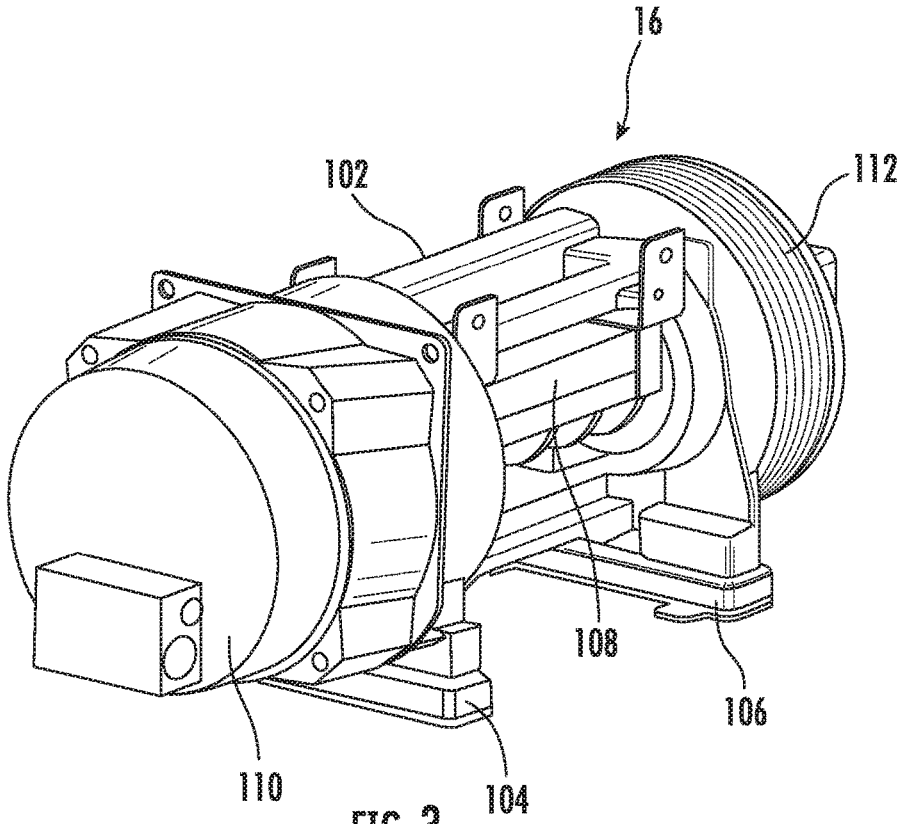
FIG. 3 is a perspective view of an elevator drive machine according to an exemplary embodiment of the invention.
Figure 4:
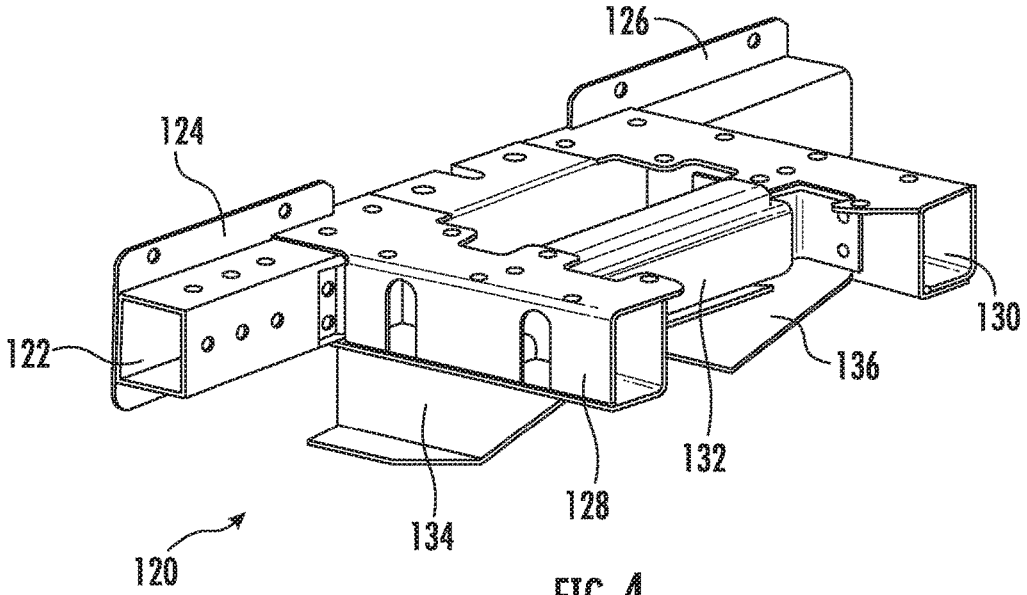
FIG. 4 is a perspective view of an exemplary bedplate according to an exemplary embodiment of the invention.
Figure 5:
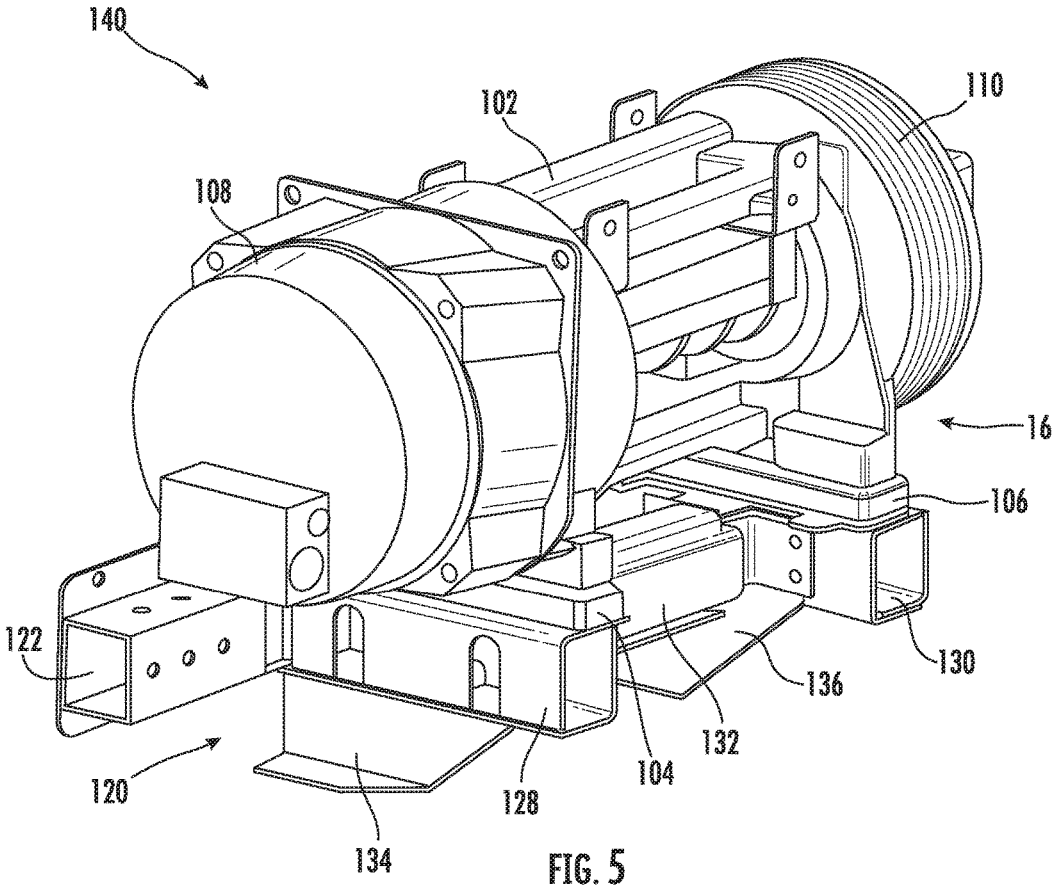
FIG. 5 is a perspective view of a drive machine assembly according to an exemplary embodiment of the invention.

FIGS. 3-5 depict a drive machine 16 and a bedplate 120 on which the drive machine 16 is mounted according to an exemplary embodiment of the invention. The drive machine 16 includes a longitudinal shaping block 102 having a first foot 104 and a second foot 106. Within the shaping block 102 is a drive sheave 108 having a plurality of areas (e.g. slots) for receiving multiple traction belts 36. A motor 110 is disposed at a first end of the drive machine 16, and a braking device 112 is located at the opposite end.

The bedplate 120 depicted in FIG. 4 includes a horizontal crossbeam 122 having flanges 124 and 126. Connected to and extending substantially perpendicularly from the crossbeam 122 are a first arm 128 and a second arm 130. A first end of each of the arms 128, 130 is mounted to the cross beam 122 using fasteners, welds, or any other known attachment means. In one embodiment, each of the arms 128, 130 extends from the crossbeam 122 a distance at least equal to a length of the feet 104, 106 of the drive machine 16. To increase the strength and rigidity of the bedplate 120, a second crossbeam 132 may be secured between the first arm 128 and the second arm 130. In addition, once the bedplate 120 is installed in the hoistway, the second crossbeam 132 may be connected to the top of the car guide rail 38. The second crossbeam 132 may be positioned closer to the second end of the arms 128, 130 than the first end of the arms 128, 130. Bedplate mounting brackets 134 and 136 extend from a portion of the bedplate, e.g. from the bottom surfaces of the first and second arms 128, 130.

FIG. 5 illustrates the drive machine 16 mounted to the bedplate 120 to form a drive machine assembly 140. The first foot 104 of the drive machine 16 is positioned on the first arm 128 of the bedplate 120, and the second foot 106 of the drive machine 16 is located on the second arm 130 of the bedplate 120. Once in the correct position, the drive machine 16 is attached to the bedplate 120 such as by fastening, welding or any other known method of attachment.

Figure 6:
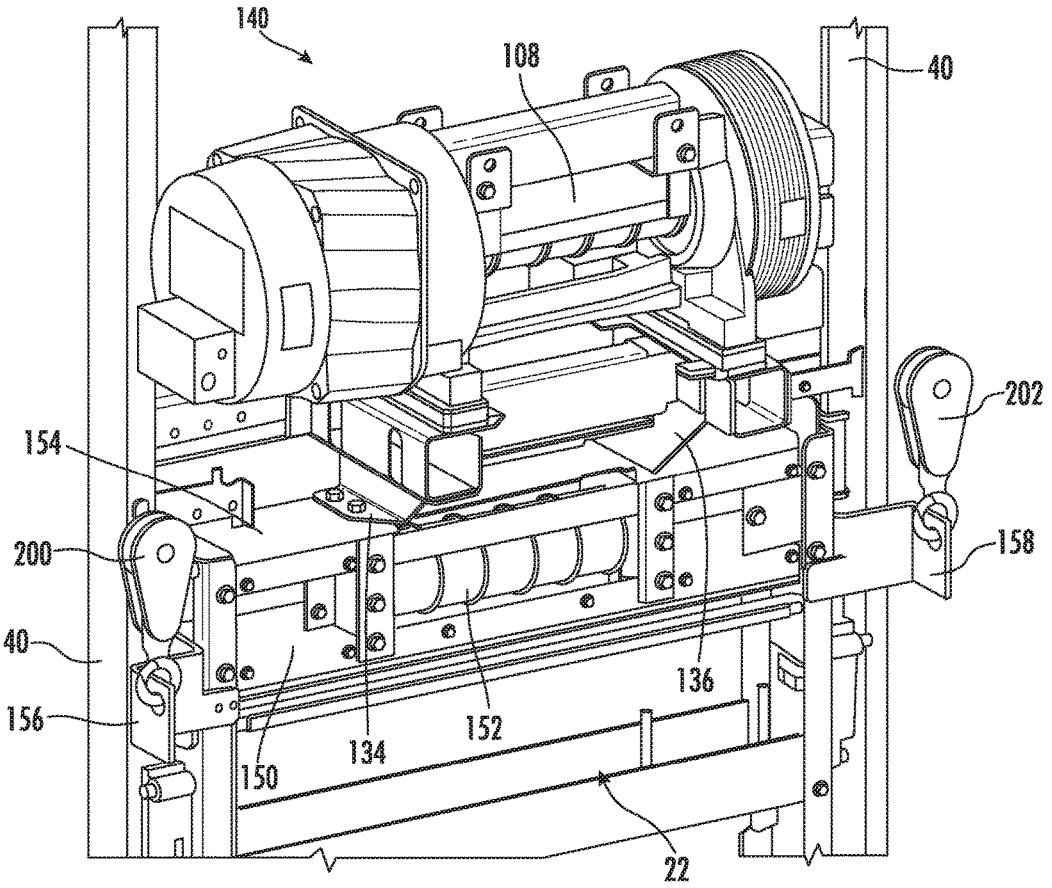
FIG. 6 is a perspective view of the drive machine assembly of FIG. 5 mounted to a counterweight according to an exemplary embodiment of the invention.

In the exemplary embodiment of the invention depicted in FIG. 6, a counterweight 22 is positioned near the bottom landing of the hoistway 14, or in the hoistway pit, where it is engaged with the counterweight guide rails 40. The drive machine assembly 140 is positioned on the counterweight 22. In one embodiment of the invention, filler weights are not been placed in the frame of the counterweight at this time in order to reduce the total load being lifted. The drive machine assembly 140 is placed on an upper surface 154 of the crosshead 150 of the counterweight 22. The drive machine assembly 140 is then removably attached to the counterweight 22 by temporarily fastening (e.g. bolting, screwing, clipping, etc.) the bedplate mounting brackets 134, 136 to the upper surface 154 of the crosshead 150. When fastened in position, the plurality of slots of the drive sheave 108 should align with the plurality of slots of an idler sheave 152 located within the crosshead 150. In an alternate embodiment of the invention, the bedplate 120 is mounted to the upper surface 154 of the crosshead 150 before the drive machine 16 is fastened to the bedplate 120.

A hoisting device, such as a winch or crane for example, is then coupled to the counterweight to raise the counterweight and the attached drive machine assembly 140 to the top of the hoistway 14. In one embodiment, a first and second hoisting bracket 156 and 158, extend from opposite sides of the counterweight 22 adjacent the counterweight guide rails 40. A first connector 200 and a second connector 202 of the hoisting device are attached to the first and second hoisting brackets 156, 158 respectively for lifting the counterweight 22 and the attached drive machine assembly 140.

Figure 7:
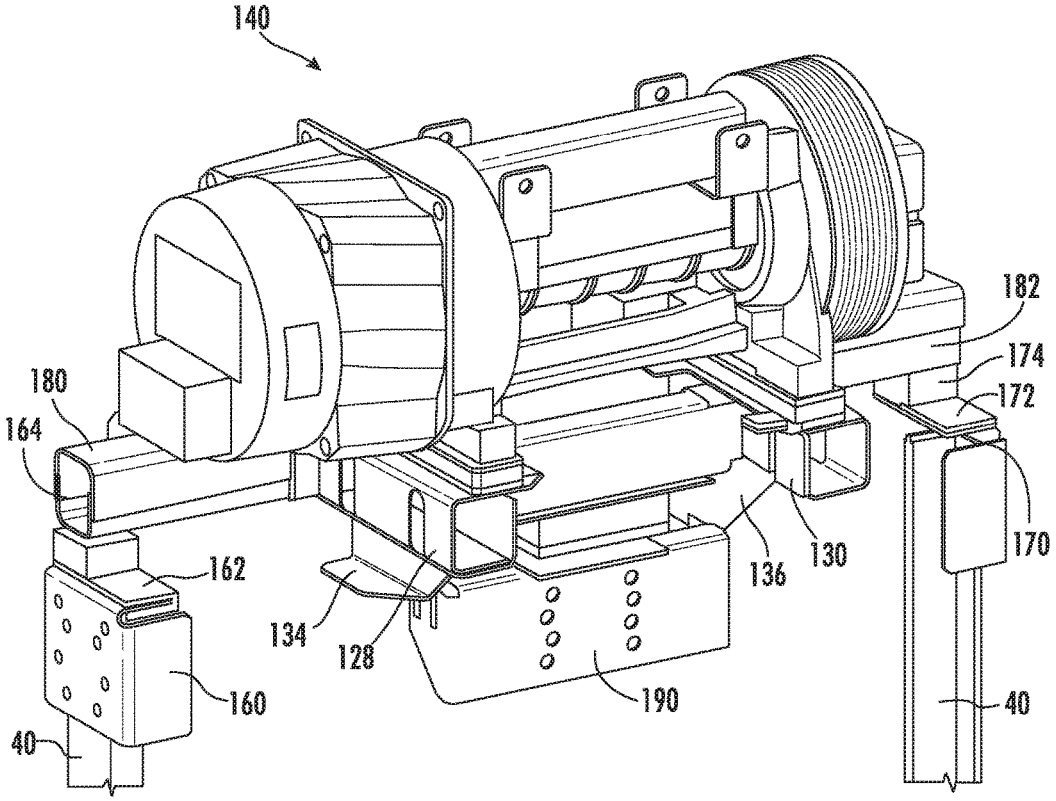
FIG. 7 is a perspective view of the drive machine assembly of FIG. 5 mounted to the counterweight guide rails according to an exemplary embodiment of the invention.

Referring now to FIG. 7, the counterweight 22 is then hoisted to the top of the hoistway 14 so that the crossbeam 122 of the drive machine assembly 140 is positioned above the end of the counterweight guide rails 40. Guide brackets 160, 170 may already be mounted to the upper end of each of the counterweight guide rails 40 when the counterweight 22 is hoisted to the top of the hoistway, or they may be added after the drive machine assembly 140 is positioned. In addition, each guide bracket 160, 170 may be mounted to an adjacent hoistway wall. In one embodiment, guide brackets 160, 170 are fastened to the guide rails using bolts. The guide brackets 160, 170 extend beyond the width of the counterweight guide rail 40 in the direction of the hoistway wall 26 adjacent the counterweight 22. At least one of the guide brackets 160, 170 may include a planar surface parallel to the length of the counterweight guide rail 40, and a substantially perpendicularly bent surface for engagement with each of the respective counterweight guide rails 40. According to some exemplary embodiments of the invention, an additional metal sheet 162, 172 may be utilized on or near the substantially perpendicularly bent surface of each bracket 160, 170 to improve the contact between the guide brackets 160, 170 and the end surface of the counterweight guide rails 40. Additionally, spacers 164, 174 may be positioned on the top surface of each to provide a clearance between the drive machine assembly 140 and the counterweight 22 when the counterweight 22 is at its uppermost position in the hoistway 14. Spacers 164, 174 may have anti-noise or anti-vibration properties.

Because the width of the crossbeam 122 is less than the width of the counterweight 22 additional support pieces 180, 182 are connected to each end of the crossbeam 122 once the counterweight 22 is positioned at the top of the hoistway, These additional support pieces 180, 182 extend the length of the drive machine assembly 140 to engage each of the guide brackets 160, 170. Support pieces 180, 182 may include angles, channel, any other structures, or a combination thereof Inclusion of these additional support pieces 180, 182 allows the drive machine assembly 140 to be adapted for use in multiple elevator systems of varying configurations. In one embodiment of the invention, a car rail bracket 190 is also mounted to a portion of the bedplate 120. As illustrated in FIG. 6, an exemplary mounting position for the car rail bracket 190 is the bottom of the first arm 128. The car rail bracket 190 may be omitted in alternate embodiments of the invention.

After the support pieces 180, 182 and the car guide rail bracket 190 are connected to the drive machine assembly 140, the drive machine assembly 140 is lowered into position, such that the ends of the additional support pieces 180, 182 contact the top surface of the spacers 164, 174 in a position offset from the center of the counterweight guide rail 40. Once in contact, the drive machine assembly 140 is fastened to the guide brackets 160, 170. In one embodiment of the invention, support pieces 180, 182 are mounted to the guide brackets 160, 170 through spacers 164, 174 using bolts. Once the drive machine assembly 140 is coupled to the guide brackets 160, 170, the drive machine assembly 140 is in its installed position in the hoistway. The car guide rails 38 of the elevator are then installed in the hoistway so that the car guide rail 38 positioned adjacent the counterweight 22 may be mounted to the car guide rail bracket 190. The bedplate mounting brackets 134, 136 are then disconnected from the crosshead 150, allowing the counterweight 22 to move away from the drive machine assembly 140 and return to the bottom of the hoistway.

Because the drive machine assembly 140 mounts to the top of the counterweight guide rails 40, the drive machine assembly 140 is installed in a position in vertical alignment with the counterweight 22. Therefore using the counterweight to install the drive machine assembly 140 does not require any additional repositioning of the drive machine assembly 140, such as in a horizontal direction relative to the counterweight 22 for example, once located at the top of the hoistway. In addition, by mounting the drive machine assembly 140 at the top of the counterweight guide rails 40, no specialized equipment is required to lift and install the drive machine assembly 140. In addition, the amount of time required to install the drive machine assembly is greatly reduced.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of installing an elevator drive machine in a hoistway, comprising:

removably connecting a drive machine assembly to a crosshead of a counterweight at a position between a pair of counterweight guide rails;

lifting the counterweight along the pair of counterweight guide rails to a top of the hoistway, the drive machine assembly being positioned in vertical alignment with the counterweight as the counterweight is lifted along the pair of counterweight guide rails;

mounting the drive machine assembly to each of the pair of counterweight guide rails; and disconnecting the drive machine assembly from the counterweight after mounting the drive machine assembly to each of the counterweight guide rails.

2. The method according to claim 1, wherein the drive machine assembly includes an elevator drive machine and a bedplate.

3. The method according to claim 2, further comprising mounting the elevator drive machine to the bedplate before removably connecting the drive machine assembly to the counterweight, and wherein removably connecting the drive machine assembly to the counterweight comprises removably connecting the bedplate to the counterweight.

4. The method according to claim 2, further comprising removably connecting at least one bedplate mounting bracket to a surface of the bedplate and to the crosshead of the counterweight.

5. The method according to claim 4, wherein disconnecting the drive machine assembly from the counterweight comprises disconnecting the at least one bedplate mounting bracket from the crosshead.

6. The method according to claim 2, further comprising mounting the drive machine assembly to a car guide rail.

7. The method according to claim 2, further comprising mounting at least one support piece to each end of a cross beam of the bedplate prior to mounting the drive machine assembly to the counterweight guide rails.

8. The method according to claim 1, wherein mounting the drive machine assembly to each of the counterweight guide rails comprises mounting the drive machine assembly to an end of each of the counterweight guide rails.

9. The method according to claim 1, wherein a first foot of the elevator drive machine is mounted to a first arm of the bedplate, and a second foot of the elevator drive machine is mounted to a second arm of the bedplate.

10. The method according to claim 1, wherein the counterweight includes a counterweight frame and the counterweight frame is empty when the counterweight is lifted along the set of counterweight guide rails to the top of the hoistway.

11. The method according to claim 1, wherein the lifting the counterweight along the set of counterweight guide rails to the top of the hoistway comprises lifting the counterweight with a hoisting device.

12. The method according to claim 1, further comprising installing the car guide rail adjacent the counterweight after mounting the drive machine assembly to the counterweight guide rails.

13. An elevator system comprising:

a counterweight coupled with a first counterweight guide rail and a second counterweight guide rail for movement in a hoistway;

a bedplate, comprising a crossbeam and a plurality of mounting arms mounted to the crossbeam, a machine assembly mounted to an end of the first counterweight guide rail and the second counterweight guide rail in vertical alignment with the counterweight, the machine assembly mounted to the bedplate; and a first support piece mounted at a first end of the crossbeam and a second support piece mounted at a second end of the crossbeam such that the first support piece and the second support piece overlap a portion of the first counterweight guide rail and the second counterweight guide rail, respectively, at least one of the first support piece and the second support piece mounted to the at least one counterweight guide rail.

14. The elevator system according to claim 13, wherein the bedplate further comprises a second crossbeam mounted between at least two of the plurality of mounting arms.

15. The elevator system according to claim 13, wherein the at least one of the first support piece and the second support piece is mounted to the at least one counterweight guide rail with a counterweight guide rail bracket.

16. The elevator system according to claim 15, wherein a spacer is positioned between the at least one counterweight guide rail bracket and the at least one of the first support piece and the second support pieces.

17. The elevator system according to claim 13, wherein a car guide rail bracket is mounted to the bedplate.

18. The elevator system according to claim 17, wherein a car guide rail is mounted to the car guide rail bracket.

* * * * *